US007162355B2

(12) United States Patent
Yoda et al.

(10) Patent No.: US 7,162,355 B2
(45) Date of Patent: Jan. 9, 2007

(54) CONSTITUENT PARTS ASSEMBLING METHOD FOR AN ACTUATING APPARATUS

(75) Inventors: Toshiyuki Yoda, Kariya (JP); Takaharu Sakou, Kariya (JP)

(73) Assignee: Denso Corporation, Kariya (JP)

( * ) Notice: Subject to any disclaimer, the term of this patent is extended or adjusted under 35 U.S.C. 154(b) by 501 days.

(21) Appl. No.: 10/793,008

(22) Filed: Mar. 5, 2004

(65) Prior Publication Data

US 2004/0172823 A1 Sep. 9, 2004

(30) Foreign Application Priority Data

Mar. 5, 2003 (JP) ..... 2003-058421
Jan. 13, 2004 (JP) ..... 2004-005867

(51) Int. Cl.
*F02D 41/24* (2006.01)

(52) U.S. Cl. ..... 701/104; 700/116; 29/890.12

(58) Field of Classification Search ..... 701/104, 701/101, 102, 114, 115; 123/478, 480; 73/119 A, 73/1.36; 700/115, 116, 231; 29/407.09, 29/407.1, 890.12, 890.124
See application file for complete search history.

(56) References Cited

U.S. PATENT DOCUMENTS 5,634,448 A 6/1997 Shinogle et al. ..... 123/480
6,260,404 B1 7/2001 Aota et al. ..... 73/1.36
6,671,611 B1 * 12/2003 Peltier ..... 701/104
6,718,254 B1 * 4/2004 Hashimoto et al. ..... 701/110
6,904,354 B1 * 6/2005 Kuegel et al. ..... 701/104
2004/0249553 A1 * 12/2004 Liskow ..... 701/104

FOREIGN PATENT DOCUMENTS

DE 4329976 A1 3/1995
DE 19520037 A-1 12/1995
EP 0915255 A2 5/1999
EP 1026384 A 8/2000
JP 7-332142 12/1995
JP 2000-501155 2/2000
WO 97/20136 6/1997
WO WO 02/44543 A 6/2002

OTHER PUBLICATIONS

French Preliminary Search Report—Dec. 12, 2005.

* cited by examiner

*Primary Examiner*—Willis R. Wolfe, Jr.
*Assistant Examiner*—Johnny H. Hoang
(74) *Attorney, Agent, or Firm*—Nixon & Vanderhye P.C.

(57) ABSTRACT

A constituent parts assembling method for an actuating apparatus includes a step of assigning ID classification to each of constituent parts with reference to characteristics difference of respective parts when these constituent parts give influence to output characteristics of an injector. In the processes of assembling these constituent parts, when a selected constituent part has a certain ID classification being assigned beforehand, this assembling method includes a step of executing constituent part selection in accordance with an instruction of constituent part designating means which designates other constituent part having an ID classification corresponding to the ID classification assigned to the selected constituent part, and also includes a step of assembling the selected constituent parts into the injector.

17 Claims, 5 Drawing Sheets

FIG. 5

| INJECTION PROCESS | | INFLUENTIAL FACTOR \ CONSTITUENT PARTS | ELECTRO-MAGNETIC VALVE | FIRST FUEL PASSAGE | SECOND FUEL PASSAGE | INJECTOR BODY | NOZZLE NEEDLE | NOZZLE BODY | SPRING |
|---|---|---|---|---|---|---|---|---|---|
| [1] | a | MAGNETIC CHARACTERISTICS OF SOLENOID | ○ | | | | | | |
| | | SET LOAD OF SPRING | | | | | | | |
| | | AIR-GAP AT ZERO LIFT | | | | | | | |
| | b | CONTROL CHAMBER VOLUME | | | | ○ | | | |
| | | FLOW AMOUNT DIFFERENCE BETWEEN FIRST AND SECOND FUEL PASSAGES | | ○ | ○ | | | | |
| | c | NEEDLE SEAT RADIUS | | | | | ○ | | |
| | | SET LOAD OF SPRING | | | | | | | |
| [2] | d | NOZZLE VALVE-OPEN FORCE | | | | | ○ | | |
| | | FLOW AMOUNT DIFFERENCE BETWEEN FIRST AND SECOND FUEL PASSAGES | | ○ | ○ | | | | |
| | e | NOZZLE HALF LIFT FLOW AMOUNT | | | | | ○ | | |
| [3] | f | NOZZLE MAXIMUM FLOW AMOUNT | | | | | | ○ | |
| | | FILTER FLOW AMOUNT | | | | ○ | | | |
| [4] | g | MAGNETIC CHARACTERISTICS OF SOLENOID | ○ | | | | | | |
| | | SET LOAD OF SPRING | | | | | | | |
| | | AIR-GAP AT MAXIMUM LIFT | | | | | | | |
| | h | FLOW AMOUNT DIFFERENCE BETWEEN FIRST AND SECOND FUEL PASSAGES | | ○ | ○ | | | | |
| | i | FLOW AMOUNT OF FIRST FUEL PASSAGE | | ○ | | | | | |
| | j | SET LOAD OF SPRING | | | | | | | ○ |
| [5] | k | FLOW AMOUNT OF FIRST FUEL PASSAGE | | ○ | | | | | |
| | | CONTROL CHAMBER VOLUME | | | | ○ | | | |
| | l | NOZZLE HALF LIFT FLOW AMOUNT | | | | | ○ | | |

CONSTITUENT PARTS ASSEMBLING METHOD FOR AN ACTUATING APPARATUS

BACKGROUND OF THE INVENTION

The present invention relates to a constituent parts assembling method for an actuating apparatus which includes a plurality of constituent parts and produces an output in response to an input signal, and more particularly relates to a technique being preferably applicable to an actuating apparatus (e.g., an injector of a fuel injection apparatus) which includes numerous mechanical constituent parts and accordingly inherently possesses the output characteristics being not easily adjustable through electric adjustment only.

One representative example of the actuating apparatuses including numerous mechanical constituent parts is an accumulator fuel injection system.

For example, a well-known injector incorporated in an accumulator fuel injection system is a 2-way valve type which includes a control chamber provided at a non-injection side of a control piston accommodated in this injector and an electromagnetic valve for open/close controlling a passage connecting the control chamber to depressurized fuel (i.e., a fuel discharge side) to drive a needle valve as well as the control piston, thereby controlling the fuel injection timing.

According to this type of injector, if necessary, an inlet orifice (i.e., an inflow orifice) and an outlet orifice (i.e., an outflow orifice) are provided at a fuel inflow side and a fuel outlet side of the control chamber, respectively. The fuel pressure in the control chamber reduces in response to valve open of the electromagnetic valve, and the lift movement of the control piston and the needle valve causes fuel injection.

In recent years, purifying exhaust gas emissions is strictly required and accordingly the requirement to reduce the difference in injection characteristics among individual injectors is increasing.

Hence, an identification pattern is given to each injector in accordance with individual injection amount characteristics. Such an identification pattern is indicated somewhere on each injector so that an electronic control unit driving and controlling this injector can read this information before or after the injector is installed on the engine. The electronic control unit corrects the injection amount characteristics of respective injectors with reference to their identification patterns so as to eliminate individual differences of the injectors, as disclosed in the Japanese Patent Application No. 7-32142 and in WO97/20136 (corresponding to the Japanese Tokuhyo No. 2000-501155).

However, the correction of the electronic control unit disclosed in the above-described prior art is performed by picking up several points on a three-dimensional map defined by fuel pressure, injection pulse, and injection amount. When the correction point excurses or deviates out of the map, it is difficult to sufficiently correct the injection amount differences caused due to individual differences of respective injectors.

Furthermore, the items that can be corrected by the electronic control unit are limited to the injection amount and the injection timing in response to the injection command. The injection rate and the injection period of the injector could not be corrected.

In other words, according to the conventional technique, to obtain a predetermined injection amount, the electronic control unit corrects the injection period to become long when the corrected injector has a low injection rate as its characteristics. On the other hand, to obtain same injection amount, the electronic control unit corrects the injection period to become short when the corrected injector has a high injection rate as its characteristics. Accordingly, the required exhaust gas purification function cannot be attained satisfactorily.

SUMMARY OF THE INVENTION

In view of the above-described problems, the present invention has an object to provide a method for assembling constituent parts of an actuating apparatus which is capable of attaining desired output characteristics through assembling processes of a plurality of constituent parts.

To accomplish the above and other related objects, the present invention provides a constituent parts assembling method for an actuating apparatus which includes a plurality of constituent parts and produces an output in response to an input signal, including the steps of:

assigning ID classification to each of the constituent parts with reference to characteristics difference of respective parts when these constituent parts give influence to output characteristics of the actuating apparatus;

in processes of assembling the constituent parts influencing the output characteristics, when a selected constituent part has a certain ID classification being assigned beforehand, executing constituent part selection in accordance with an instruction of constituent part designating means which designates other constituent part having an ID classification corresponding to the ID classification assigned to the selected constituent part; and assembling the selected constituent parts into the actuating apparatus.

By adopting the above-described constituent parts assembling method for an actuating apparatus, it becomes possible to attain desired output characteristics through assembling processes of a plurality of constituent parts.

Namely, the present invention makes it possible to assure desired output characteristics for an actuating apparatus even when this apparatus includes numerous mechanical constituent parts and accordingly output characteristics are not easily adjustable through electric adjustment only.

According to the constituent parts assembling method for an actuating apparatus in accordance with the present invention, it is preferable that the actuating apparatus is a 2-way valve type injector which controls a pressure in a control chamber by opening or closing an electromagnetic valve in accordance with a valve open/close signal supplied from an outside and executes a lift control of a needle valve in response to pressure change occurring in the control chamber to control the fuel injection of a nozzle.

More specifically, in the processes of assembling constituent parts influencing the output characteristics of the injector, if a selected constituent part has a certain ID classification being assigned beforehand, the present invention executes constituent part selection in accordance with an instruction of constituent part designating means which designates other constituent part having an ID classification corresponding to the ID classification assigned to the selected constituent part.

Adopting the above-described constituent parts assembling method enables to assure desired output characteristics for each injector.

More specifically, even when an injector has output characteristics being not easily corrected by the electronic control unit, it becomes possible to adjust the output characteristics of the injector to desired values.

Accordingly, it is unnecessary to execute the conventional correction performed by the electronic control unit which includes the step of picking up some correction points on the three-dimensional map defined by fuel pressure, injection pulse, and injection amount. Thus, a desired injection amount is obtained in a wide operating range of an engine. Furthermore, it enables to set the injection rate of each injector to desired output characteristics and accordingly the individual differences among the manufactured injectors can be reduced greatly. It enables to obtain a desired injection amount, desired injection start timing, and desired injection stop timing in a wide operating range of an engine. It becomes possible to attain the required exhaust gas purification function.

According to the constituent parts assembling method for an actuating apparatus in accordance with the present invention, it is preferable that, in a process of assembling a constituent part influencing the "response delay in a valve rising action responsive to a valve-open signal given to the electromagnetic valve to instruct an injection start" among output characteristics of the injector, the method includes a step of selecting an "adjusting plate of a valve spring which presses the valve to a valve-closing direction" having an ID classification corresponding to an ID classification assigned to a "solenoid" generating a magnetic force in the electromagnetic valve, and also includes a step of selecting a "valve with an armature magnetically driven by the solenoid" having an ID classification corresponding to an ID classification assigned to the "solenoid."

This arrangement enables to optimize the "response delay in a valve rising action" among the output characteristics of each injector.

According to the constituent parts assembling method for an actuating apparatus in accordance with the present invention, it is preferable that, in a process of assembling a constituent part influencing a "rate of pressure decrease in the control chamber from opening the electromagnetic valve to opening the needle valve" among output characteristics of the injector, the method includes a step of selecting a "first passage member having an inlet orifice for restricting pressurized fuel supplied to the control chamber" having an ID classification corresponding to an ID classification assigned to an "injector body" determining a volume of the control chamber, and also includes a step of selecting a "second passage member having an outlet orifice for restricting the fuel discharged from the control chamber in response to valve open of the valve" having an ID classification corresponding to an ID classification assigned to the "injector body."

This arrangement enables to optimize the "rate of pressure decrease in the control chamber" among the output characteristics of each injector.

According to the constituent parts assembling method for an actuating apparatus in accordance with the present invention, it is preferable that, in a process of assembling a constituent part influencing a "rate of pressure decrease in the control chamber from opening the electromagnetic valve to opening the needle valve" among output characteristics of the injector, the method includes a step of selecting an "injector body determining a volume of the control chamber" having an ID classification corresponding to an ID classification assigned to a "first passage member" having an inlet orifice restricting pressurized fuel supplied to the control chamber, and also includes a step of selecting a "second passage member having an outlet orifice restricting the fuel discharged from the control chamber in response to valve open of the valve" having an ID classification corresponding to an ID classification assigned to the "first passage member."

This arrangement enables to optimize the "rate of pressure decrease in the control chamber" among the output characteristics of each injector.

According to the constituent parts assembling method for an actuating apparatus in accordance with the present invention, it is preferable that, in a process of assembling a constituent part influencing a "rate of pressure decrease in the control chamber from opening the electromagnetic valve to opening the needle valve" among output characteristics of the injector, the method comprises a step of selecting an "injector body determining a volume of the control chamber" having an ID classification corresponding to an ID classification assigned to a "second passage member" having an outlet orifice restricting the fuel discharged from the control chamber in response to valve open of the valve, and also includes a step of selecting a "first passage member having an inlet orifice restricting pressurized fuel supplied to the control chamber" having an ID classification corresponding to an ID classification assigned to the "second passage member."

This arrangement enables to optimize the "rate of pressure decrease in the control chamber" among the output characteristics of each injector.

According to the constituent parts assembling method for an actuating apparatus in accordance with the present invention, it is preferable that, in a process of assembling a constituent part influencing the "control chamber pressure during a predetermined period from a time the control chamber pressure has reached a valve-open pressure to a time the needle valve actually starts a valve opening action" among output characteristics of the injector, the method includes a step of selecting an "adjusting plate of a needle spring for pressing the needle valve to a valve-closing direction" having an ID classification corresponding to an ID classification assigned to the "needle valve."

This arrangement enables to optimize the "control chamber pressure during a predetermined period from a time the control chamber pressure has reached a valve-open pressure to a time the needle valve actually starts a valve opening action" among the output characteristics of each injector.

According to the constituent parts assembling method for an actuating apparatus in accordance with the present invention, it is preferable that, in a process of assembling a constituent part influencing a "rising speed of the needle valve" among output characteristics of the injector, the method includes a step of selecting a "first passage member having an inlet orifice for restricting pressurized fuel supplied to the control chamber" having an ID classification corresponding to an ID classification assigned to the "needle valve", and also includes a step of selecting a "second passage member having an outlet orifice restricting the fuel discharged from the control chamber in response to valve open of the valve" having an ID classification corresponding to an ID classification assigned to the "needle valve."

This arrangement enables to optimize the "rising speed of the needle valve" among the output characteristics of each injector.

According to the constituent parts assembling method for an actuating apparatus in accordance with the present invention, it is preferable that, in a process of assembling a constituent part influencing a "rising speed of the needle valve" among output characteristics of the injector, the method includes a step of selecting a "needle valve" having an ID classification corresponding to an ID classification assigned to a "first passage member" having an inlet orifice restricting pressurized fuel supplied to the control chamber and selecting a step of selecting a "second passage member having an outlet orifice for discharging the fuel discharged from the control chamber in response to valve open of the valve" having an ID classification corresponding to an ID classification assigned to the "first passage member."

This arrangement enables to optimize the "rising speed of the needle valve" among the output characteristics of each injector.

According to the constituent parts assembling method for an actuating apparatus in accordance with the present invention, it is preferable that, in a process of assembling a constituent part influencing a "rising speed of the needle valve" among output characteristics of the injector, the method includes a step of selecting a "needle valve" having an ID classification corresponding to an ID classification assigned to a "second passage member" having an outlet orifice for restricting the fuel discharged from the control chamber, and also includes a step of selecting a "first passage member having an inlet orifice for restricting pressurized fuel supplied to the control chamber" having an ID classification corresponding to an ID classification assigned to the "second passage member."

According to the constituent parts assembling method for an actuating apparatus in accordance with the present invention, it is preferable that, in a process of assembling a constituent part influencing an "injection rate during a rising action of the needle valve" among output characteristics of the injector, the method includes the step of selecting an "injector part influencing a rising speed of the needle valve" having an ID classification corresponding to an ID classification assigned to the "nozzle."

This arrangement enables to optimize the "injection rate during a rising action of the needle valve" among the desired output characteristics of each injector.

According to the constituent parts assembling method for an actuating apparatus in accordance with the present invention, it is preferable that, in a process of assembling a constituent part influencing an "injection rate during a rising action of the needle valve" among output characteristics of the injector, the method includes the step of selecting a "nozzle" having an ID classification corresponding to an ID classification assigned to an "injector component influencing a rising speed of the needle valve."

This arrangement enables to optimize the "injection rate during a rising action of the needle valve" among the output characteristics of each injector.

According to the constituent parts assembling method for an actuating apparatus in accordance with the present invention, it is preferable that, in a process of assembling a constituent part influencing a "maximum injection rate" among output characteristics of the injector, the method includes the step of selecting a "filter for filtering pressurized fuel flowing into the injector" having an ID classification corresponding to an ID classification assigned to a "nozzle body" having a nozzle hole being open/close controlled by the needle valve.

This arrangement enables to optimize the "maximum injection rate" among the output characteristics of each injector.

According to the constituent parts assembling method for an actuating apparatus in accordance with the present invention, it is preferable that, in a process of assembling a constituent part influencing a "maximum injection rate" among output characteristics of the injector, the method includes the step of selecting a "nozzle body having a nozzle hole being open/close controlled by the needle valve" having an ID classification corresponding to an ID classification assigned to a "filter for filtering pressurized fuel flowing into the injector."

This arrangement enables to optimize the "maximum injection rate" among the output characteristics of each injector.

According to the constituent parts assembling method for an actuating apparatus in accordance with the present invention, it is preferable that, in a process of assembling a constituent part influencing "response delay in a valve falling action responsive to a valve-close signal given to the electromagnetic valve to instruct an injection stop" among output characteristics of the injector, the method includes a step of selecting an "adjusting plate of a valve spring which presses the valve to a valve-closing direction" having an ID classification corresponding to an ID classification assigned to a "solenoid" generating a magnetic force in the electromagnetic valve, and also includes a step of selecting a "valve equipped with an armature magnetically driven by the solenoid" having an ID classification corresponding to an ID classification assigned to the "solenoid."

This arrangement enables to optimize the "response delay in a valve falling action" among the output characteristics of each injector.

According to the constituent parts assembling method for an actuating apparatus in accordance with the present invention, it is preferable that, in a process of assembling a constituent part influencing a "falling speed of the needle valve" among output characteristics of the injector, the method includes the step of selecting a "first passage member having an inlet orifice for restricting pressurized fuel supplied to the control chamber" having an ID classification corresponding to an ID classification assigned to an "injector body" determining a volume of the control chamber.

This arrangement enables to optimize the "falling speed of the needle valve" among the output characteristics of each injector.

According to the constituent parts assembling method for an actuating apparatus in accordance with the present invention, it is preferable that, in a process of assembling a constituent part influencing a "falling speed of the needle valve" among output characteristics of the injector, the method includes the step of selecting an "injector body determining a volume of the control chamber" having an ID classification corresponding to an ID classification assigned to "first passage member" having an inlet orifice for restricting pressurized fuel supplied to the control chamber.

This arrangement enables to optimize the "falling speed of the needle valve" among the output characteristics of each injector.

BRIEF DESCRIPTION OF THE DRAWINGS

The above and other objects, features and advantages of the present invention will become more apparent from the following detailed description which is to be read in conjunction with the accompanying drawings, in which:

FIG. 5 is a table showing influential factors and relevant constituent parts

DESCRIPTION OF THE PREFERRED EMBODIMENTS

The best mode of the present invention provides a constituent parts assembling method for an actuating apparatus which includes a plurality of constituent parts and produces an output in response to an input signal. The constituent parts assembling method of the best mode includes a step of assigning ID classification to each of the constituent parts with reference to characteristics difference of respective parts when these constituent parts give influence to output characteristics of the actuating apparatus. In processes of assembling the constituent parts influencing the output characteristics, when a selected constituent part has a certain ID classification being assigned beforehand, the assembling method of the best mode includes a step of executing constituent part selection in accordance with an instruction of constituent part designating means which designates other constituent part having an ID classification corresponding to the ID classification assigned to the selected constituent part. And then, the assembling method of the best mode executes a step of assembling the selected constituent parts into the actuating apparatus.

First Embodiment

A preferred embodiment and a modified embodiment of the present invention will be explained based on an injector of an accumulator fuel injection system.

Figure 1:
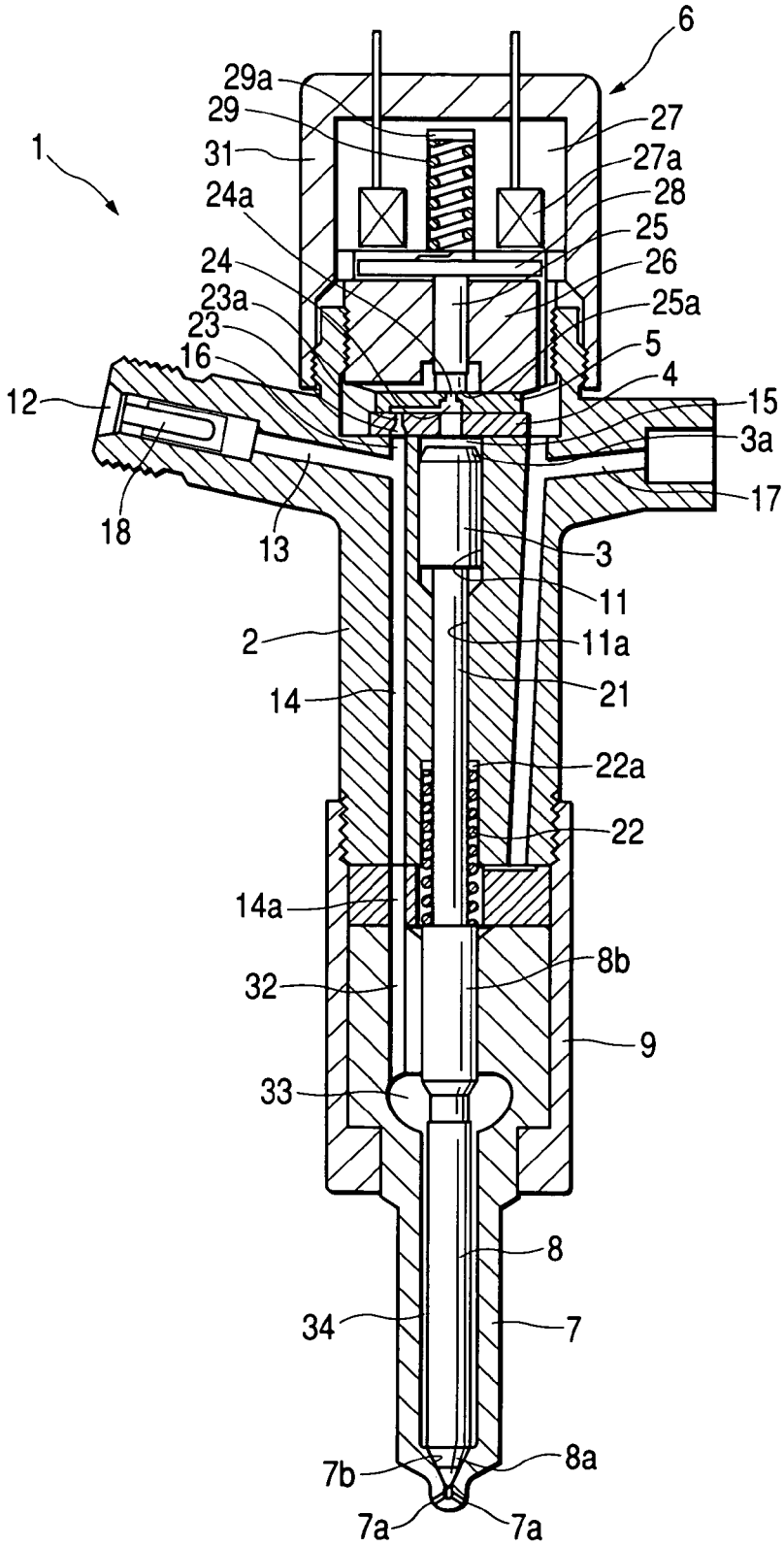
FIG. 1 is a vertical cross-sectional view showing the arrangement of an injector in accordance with a preferred embodiment of the present invention.

An injector 1 shown in FIG. 1 is, for example, incorporated into an accumulator fuel injection system for a diesel engine. The injector 1 receives pressurized fuel supplied from a common rail (not shown) and injects the pressurized fuel into an engine combustion chamber. The embodiment disclosed in FIG. 1 is a 2-way valve type injector.

Arrangement of Injector 1

First of all, the arrangement of the injector 1 will be explained.

The injector 1 includes a nozzle (described later), an injector body 2, a control piston 3, first and second passage members 4 and 5, and an electromagnetic valve 6.

The nozzle includes a nozzle body 7 having a nozzle hole 7*a* formed at its distal end and a needle valve 8 slidably coupled in an inside space of the nozzle body 7. The nozzle body 7 is fixed to the lower part of the injector body 2 by means of a retaining nut 9. The needle valve 8 has a needle seat 8*a* being configured into a conical surface and provided at a distal end (i.e., at a lower end). The nozzle body 7 has a nozzle seat 7*b* being configured into a conical surface corresponding to the needle seat 8*a* of the needle valve 8. The needle seat 8*a* and the nozzle seat 7*b* cooperatively constitute a fluid-tight valve seat.

The injector body 2 includes a cylinder 11 accommodating a control piston 3, a pressurized fuel passage 13 extending from a fuel inlet portion 12 to introduce pressurized fuel from a common rail (not shown) via a fuel pipe, a fuel passage 14 guiding the supplied pressurized fuel from the pressurized fuel passage 13 toward the nozzle, a fuel passage 16 guiding the supplied pressurized fuel from the pressurized fuel passage 13 toward a control chamber 15, and a discharge passage 17 discharging the pressurized fuel toward a depressurized side. Furthermore, the fuel inlet portion 12 is equipped with a filter 18 which traps foreign substances contained in the fuel.

The control piston 3 is connected to the needle valve 8 via a pressure pin 21. The pressure pin 21 is slidable in a through-hole 11*a* of the injector body 2. The control piston 3 and the pressure pin 21 can be formed integrally. The pressure pin 21 intervenes between the control piston 3 and the needle valve 8. A needle valve spring 22, disposed around the pressure pin 21, resiliently presses the needle valve 8 downward (i.e., in the valve-closing direction). An adjusting plate (shim) 22*a*, positioned at the upper end of the needle valve spring 22, has the role of adjusting a set load of the needle valve spring 22.

The first and second passage members 4 and 5 are disposed on an end surface of the injector body 2 which opens at the upper end of the cylinder 11. The control chamber 15 is defined in the cylinder 11 at an upper side of the control piston 3. The first passage member 4, positioned underneath the second passage member 5, has a first fuel passage 23 connecting the fuel passage 16 to the control chamber 15. The first fuel passage 23 has an inlet orifice 23*a* which restricts the pressurized fuel flowing into the control chamber 15.

Furthermore, the second passage member 5, located on the first passage member 4, has a second fuel passage 24 connecting the control chamber 15 to the discharge passage 17 (i.e., the depressurized side). The second fuel passage 24 has an outlet orifice 24*a* which restricts the fuel exiting from the control chamber 15 to the depressurized side. The second fuel passage 24 is positioned at the center of the second passage member 5. An electromagnetic valve 6 has a valve 25 for opening and closing the second fuel passage 24. The first and second passage members 4 and 5 are installed to the upper part of the injector body 2 and are fixed together by fastening a support member 26 of the valve 25 to the injector body 2.

As described above, the valve 25 of the electromagnetic valve 6 serves as a member for opening and closing the second fuel passage 24 (i.e., outlet orifice 24*a*). A coil 27*a* of a solenoid 27 magnetically drives an armature 28 fixed on the valve 25.

A valve spring 29, installed in a central bore of the solenoid 27, resiliently presses the valve 25 together with the fixed armature 28 downward (i.e., in the valve-closing direction). An adjusting plate (shim) 29*a*, positioned at the upper end of the valve spring 29, has the role of adjusting a set load of the valve spring 29. The electromagnetic valve 6 having the above-described arrangement is fixed to the upper part of the injector body 2 by means of a retaining nut 31.

Operation of Injector 1

The above-described injector 1 operates in the following manner.

A pressurized fuel supply pump (not shown) supplies the pressurized fuel to the injector 1 via the common rail and the fuel pipe (both not shown).

OFF condition of Electromagnetic Valve 6

An electronic control unit (ECU), not shown in the drawing, generates a valve open/close signal which is fed to the coil 27*a* of solenoid 27. When the valve open/close signal is in an OFF condition (i.e., when an injector drive current is ON), the valve spring 29 located in the electromagnetic valve 6 resiliently depresses the armature 28 downward and accordingly the valve seat 25*a* attached to the lower end of the valve 25 lands on the upper surface of second passage member 5 so as to close the outlet orifice 24*a*.

Accordingly, the control chamber 15, the fuel passages 14, 14*a*, 16 extending from the inlet orifice 23*a*, an oil passage 32 of the nozzle, a fuel storage 33, and a fuel passage 34 formed between the nozzle body 7 and the needle valve 8 are filled with the pressurized fuel.

At this moment, an axial force (i.e., a valve closing force F1) acts on the needle valve 8. The a valve closing force F1 is a sum of a load acting on a top surface 3*a* of the control piston 3 and a spring load applied by the needle valve spring 22. The load acting on the top surface 3*a* of control piston 3 is expressed by a multiplication of the fuel pressure in the control chamber 15 and an area of the top surface 3*a* of the control piston 3.

On the other hand, the needle valve 8 receives a valve opening force F2 which is proportional to a difference in cross section between a guide 8*b* of needle valve 8 and a needle seat 8*a* and is expressed by a multiplication of this difference and the fuel pressure. The cross-sectional area of the top surface 3*a* of control piston 3, the set load of needle valve spring 22, and the radius of the needle seat 8*a* are determined so as to satisfy the relationship that the valve closing force F1 is larger than the valve opening force F2 (i.e., F1>F2). Thus, the needle valve 8 does not take off the nozzle seat 7*b* and accordingly closes the nozzle hole 7*a*. Thus, no fuel injection is performed.

ON condition of Electromagnetic Valve 6

When the valve open/close signal supplied from the electronic control unit to the coil 27*a* of solenoid 27 is in an ON condition (i.e., when an injector drive current is OFF), the armature 28 lifts upward against the resilient force of the valve spring 29. Accordingly, the valve seat 25*a* attached to the lower end of valve 25 departs upward from the upper surface of the second passage member 5 so as to open the outlet orifice 24*a*.

In response to the opening of the outlet orifice 24*a* (i.e., the second fuel passage 24), the fuel stored in the control chamber 15 flows out via the outlet orifice 24*a* to the depressurized side. At this moment, a significant amount of pressurized fuel tries to flow into the control chamber 15 via the inlet orifice 23*a* of first fuel passage 23. However, due to settings for the diameters of the inlet orifice 23*a* and the outlet orifice 24*a*, the control chamber 15 can cause a sufficient decrease in pressure. Hence, the fuel pressure acting on the top surface 3*a* of control piston 3 decreases and the valve closing force F1 decreases correspondingly. As soon as the valve closing force F1 becomes smaller than the valve opening force F2 (i.e., F1<F2), the needle valve 8 starts rising and the needle seat 8*a* disengages from the nozzle seat 7*b*. As a result, the fuel is injected from the nozzle hole 7*a*. Turning OFF from ON of Electromagnetic Valve 6

When the valve open/close signal supplied from the electronic control unit to the coil 27*a* of solenoid 27 is switched from ON to OFF, the coil 27*a* cannot generate the magnetic force. The valve spring 29 resiliently presses the armature 28 back to the original position and accordingly the valve 25 again closes the outlet orifice 24*a* (i.e., the second fuel passage 24).

Thus, the pressurized fuel enters into the control chamber 15 via the inlet orifice 23*a*. The pressure in the control chamber 15 increases. The fuel pressure applied on the top surface 3*a* of control piston 3 increases and the valve closing force F1 increases correspondingly. As soon as the valve closing force F1 becomes larger than the valve opening force F2 (i.e., F1>F2), the needle valve 8 starts falling and the needle seat 8*a* lands on the nozzle seat 7*b*. As a result, the fuel injection is stopped.

Characteristic Features of Embodiment

The injector 1, as described above, includes numerous constituent parts and produces various outputs (later-described) in response to the input signal (ON and OFF of the above-described valve open/close signal).

As described in the description of the prior art, in recent years, the requirement to reduce the difference in injection characteristics among individual injectors is increasing. Hence, an identification pattern is given to each injector 1 in accordance with individual injection amount characteristics. The electronic control unit can read this information and corrects the injection amount characteristics of each injector with reference to its identification pattern so as to eliminate individual differences of the injectors, However, the correction of the electronic control unit disclosed in the above-described prior art is performed by picking up several points on a three-dimensional map defined by fuel pressure, injection pulse, and injection amount. When the correction point excurses or deviates out of the map, it is difficult to sufficiently correct the injection amount differences caused due to individual differences of respective injectors.

Furthermore, the items that can be corrected according to the conventional correcting method are limited to the injection amount and the injection timing in accordance with the injection command. The injection rate and the injection period of the injector could not be corrected.

In view of the foregoing, the injector 1 in accordance with the preferred embodiment of the present invention adjusts the output characteristics being not conventionally adjustable to desired output characteristics.

Figure 2:
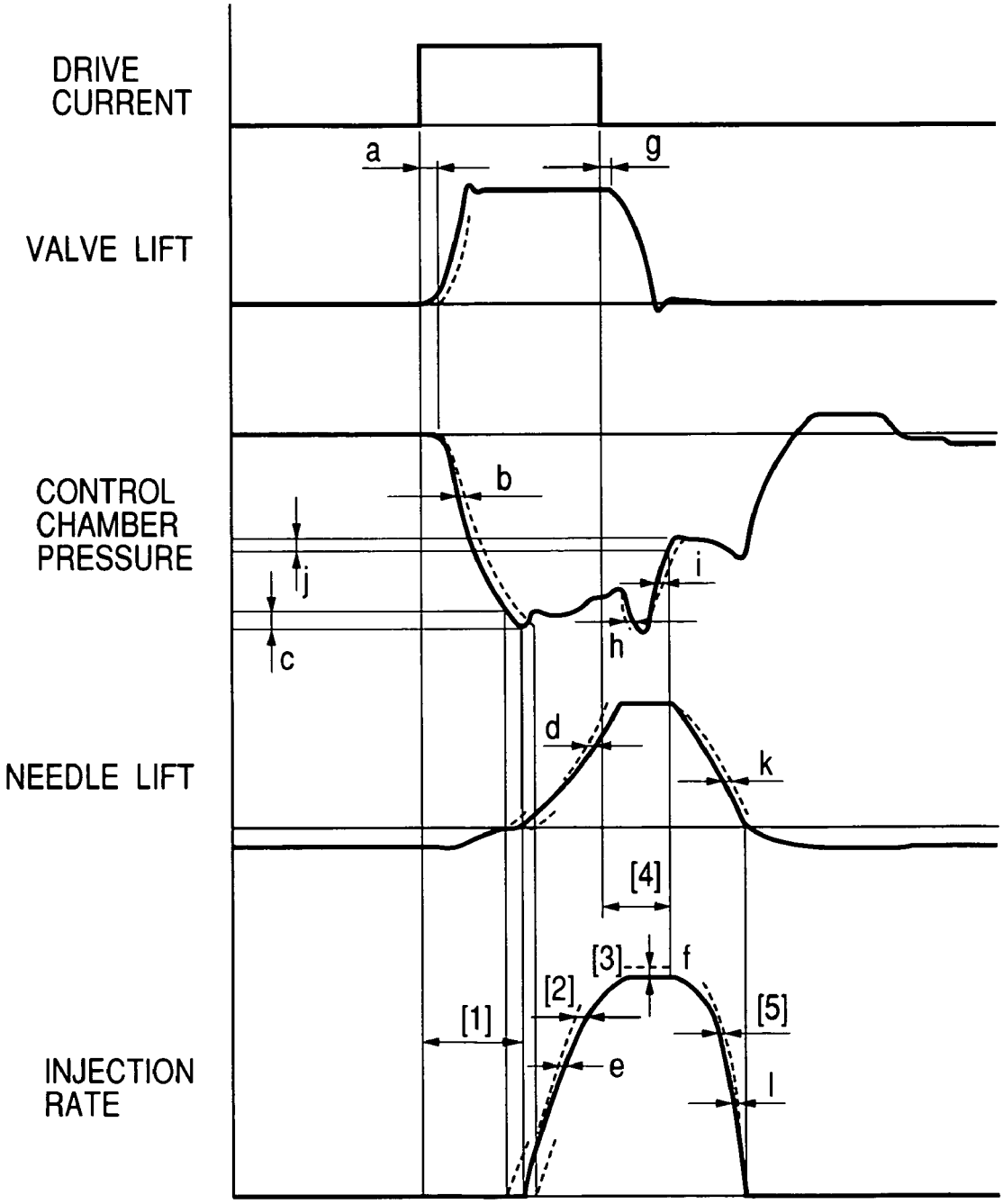
FIG. 2 is a timing chart explaining the operation of the injector in accordance with the preferred embodiment of the present invention.

More specifically, various adjustable output characteristics of the injector 1 will be explained with reference to FIG. 2. The output characteristics of the injector 1 are chiefly classified into five representative output characteristics.

[1] Duration from ON of coil 27*a* of solenoid 27 to start of injection (hereinafter, referred to as "injection start delay period").

[2] Duration in which the injection rate increases in accordance with a rising action of the needle valve 8 (hereinafter, referred to as "injection rate increasing period").

[3] Injection rate (hereinafter, referred to as "maximum injection rate") at a time the injection amount injected from the nozzle of injector 1 has reached the maximum value (when the total area of nozzle hole 7*a* is larger than the minimum passage area defined between the nozzle seat 7*b* and the needle seat 8*a*).

[4] Duration from OFF of coil 27*a* of solenoid 27 to start of falling in injection rate (hereinafter, referred to as "needle valve falling delay period").

[5] Duration in which the injection rate decreases in accordance with a falling action of the needle valve 8 (hereinafter, referred to as "injection rate decreasing period").

Among the output characteristics of the injector 1, the injection start delay period defined in the above-described item [1] is determined depending on the following three output characteristics.

(a) "Response delay in a valve rising action" responsive to a valve-open signal (ON of coil 27*a*) given to the electromagnetic valve 6 to instruct an injection start.

(b) "Rate of pressure decrease in the control chamber" prior to a rising action of the needle valve 8 succeeding to valve open of the electromagnetic valve 6.

(c) "Control chamber pressure (hereinafter, referred to as needle valve-open requisite pressure) during a predetermined period from a time the pressure of control chamber 15 has reached a valve-open pressure to a time the needle valve 8 actually starts rising.

Among the output characteristics of the injector 1, the injection rate increasing period defined in the above-described item [2] is determined depending on the following two output characteristics.

(d) "Needle valve rising speed" in the rising action of the needle valve 8.

(e) "Needle valve rising stage injection rate" in the rising action of the needle valve 8.

Among the output characteristics of the injector 1, the maximum injection rate defined in the above-described item [3] is determined depending on the following output characteristics.

(f) "Maximum injection rate" at a time the lift amount of the needle valve 8 has reached the maximum value {i.e.,[3]=(f)}.

Among the output characteristics of the injector 1, the needle valve falling delay period defined in the above-described item [4] is determined depending on the following four output characteristics.

(g) "Response delay in a valve falling action" responsive to a valve-close signal (OFF of coil 27*a*) given to the electromagnetic valve 6 to instruct an injection stop.

(h) "Rate of pressure decrease in the control chamber" when the needle valve 8 is positioned at the maximum lift level.

(i) "Rising speed of the control chamber pressure" responsive to a valve-close signal (OFF of coil 27*a*) given to the electromagnetic valve 6 to instruct an injection stop.

(j) "Control chamber pressure (hereinafter, referred to as needle valve-close requisite pressure)" during a predetermined period from a time the pressure of control chamber 15 has reached a valve-close pressure to a time the needle valve 8 actually starts falling.

Among the output characteristics of the injector 1, the injection rate decreasing period defined in the above-described item [5] is determined depending on the following two output characteristics.

(k) "Needle valve falling speed" in the falling action of the needle valve 8.

(l) "Needle valve falling stage injection rate" in the falling action of the needle valve 8.

As apparent from the foregoing description, the injector 1 has the above-described output characteristics (a) to (l).

In assembling the injector 1, this embodiment includes a step of assigning ID classification to each of the constituent parts with reference to characteristics difference of respective parts when these constituent parts give influence to the output characteristics of injector 1.

In the processes of assembling the constituent parts influencing the output characteristics, when a selected constituent part has a certain ID classification being assigned beforehand, this embodiment includes a step of executing constituent part selection in accordance with an instruction of constituent part designating means which designates other constituent part having an ID classification corresponding to the ID classification assigned to the selected constituent part, and also includes a step of assembling the selected constituent parts into the actuating apparatus.

The constituent part designating means is, for example, a microcomputer which installs software necessary to designate other constituent part having an ID classification corresponding to the ID classification assigned to each selected constituent part. This embodiment can use a matrix or a pre-selected map serving as the constituent part designating means.

The table shown in FIG. 5 is a list of influential factors (i.e., output characteristics a to l) influencing individual differences of injectors 1 and constituent parts influencing these influential factors (output characteristics). In this table, the constituent part indicated by ○ is a component that cannot be adjusted in the assembling of the injector 1 and the output characteristics of this component need to be adjusted by other constituent parts being not indicated by ○. No ID classification is necessary for the constituent parts giving no influence to the injection characteristics with respect to respective output characteristics (a) to (l) shown in this table.

Next, in the assembling of a plurality of constituent parts, an assembling method for attaining desired output characteristics will be explained with reference to the table shown in FIG. 5. As this method is based on the assembling a plurality of constituent parts to attain the desired output characteristics, the present invention excludes a case that an adjustment of the output characteristics is determined by only one constituent part.

More specifically, the assembling method for attaining desired output characteristics through assembling of a plurality of constituent parts is applicable to (a) "response delay in a valve rising action", (b) "rate of pressure decrease in the control chamber", (c) "needle valve-open requisite pressure", (d) "needle valve rising speed", (e) "needle valve rising stage injection rate" (f) "maximum injection rate", (g) "response delay in a valve falling action", (k) "needle valve falling speed", and (l) "needle valve falling stage injection rate", among the above-described output characteristics (a) to (l). However, this assembling method is not applicable to (h) "rate of pressure decrease in the control chamber", (i) "rising speed of the control chamber pressure", and (j) "needle valve-close requisite pressure" according to which the adjustment of the output characteristics is determined by only one constituent part Next, a practical assembling method of the present invention will be explained in more detail.

(a) In the case that the "response delay in a valve rising action" needs to be adjusted to desired characteristics, the following assembling method is employed.

(a-1) First, this assembling method includes a step of determining a "solenoid 27" to be assembled. Then, with the aid of the constituent part designating means such as a selection matrix, this assembling method performs a step of selecting an "adjusting plate 29*a* of a valve spring 29" having an ID classification (i.e., ID code classified in accordance with the set load of the valve spring 29) corresponding to an ID classification assigned to the "solenoid 27" (i.e., ID code classified in accordance with the magnetic characteristics of the solenoid 27), and further performs a step of selecting a "valve 25 equipped with an armature 28" having an ID classification (i.e., ID code classified in accordance with the air-gap amount at the zero lift of the valve 25) corresponding to an ID classification assigned to the "solenoid 27" (i.e., ID code classified in accordance with the magnetic characteristics of the solenoid 27).

By assembling the "solenoid 27", the "adjusting plate 29*a* of valve spring 29", and the "valve 25" being thus selected, it becomes possible to adjust the "response delay in a valve rising action" to desired characteristics.

(b) In the case that the "rate of pressure decrease in the control chamber" needs to be adjusted to desired characteristics, one of the following three assembling methods is employed.

(b-1) The first method includes a step of determining an "injector body 2" to be assembled. Then, with the aid of the constituent part designating means such as a selection matrix, this assembling method performs a step of selecting a "first passage member 4" having an ID classification (i.e., ID code classified in accordance with the restricting characteristics of the inlet orifice 23*a*) corresponding to an ID classification assigned to the "injector body 2" (i.e., ID code classified in accordance with the volume of the control chamber 15), and further performs a step of selecting a "second passage member 5" having an ID classification (i.e., ID code classified in accordance with the restricting characteristics of the outlet orifice 24*a*) corresponding to an ID classification assigned to the "injector body 2" (i.e., ID code classified in accordance with the volume of the control chamber 15).

By assembling the "injector body 2", the "first passage member 4", and the "second passage member 5" being thus selected, it becomes possible to adjust the "rate of pressure decrease in the control chamber" to desired characteristics.

(b-2) The second method includes a step of determining a "first passage member 4" to be assembled. Then, with the aid of the constituent part designating means such as a selection matrix, this assembling method performs a step of selecting an "injector body 2" having an ID classification (i.e., ID code classified in accordance with the volume of the control chamber 15) corresponding to an ID classification assigned to a "first passage member 4" (i.e., ID code classified in accordance with the restricting characteristics of the inlet orifice 23*a*), and further performs a step of selecting a "second passage member 5" having an ID classification (i.e., ID code classified in accordance with the restricting characteristics of the outlet orifice 24*a*) corresponding to an ID classification assigned to the "first passage member 4" (i.e., ID code classified in accordance with the restricting characteristics of the inlet orifice 23*a*).

By assembling the "first passage member 4", the "injector body 2", and the "second passage member 5" being thus selected, it becomes possible to adjust the "rate of pressure decrease in the control chamber" to desired characteristics.

(b-3) The third method includes a step of determining a "second passage member 5" to be assembled. Then, with the aid of the constituent part designating means such as a selection matrix, this assembling method performs a step of selecting an "injector body 2" having an ID classification (i.e., ID code classified in accordance with the volume of the control chamber 15) corresponding to an ID classification assigned to a "second passage member 5" (i.e., ID code classified in accordance with the restricting characteristics of the outlet orifice 24*a*), and further performs a step of selecting a "first passage member 4" having an ID classification (i.e., ID code classified in accordance with the restricting characteristics of the inlet orifice 23*a*) corresponding to an ID classification assigned to the "second passage member 5" (i.e., ID code classified in accordance with the restricting characteristics of the outlet orifice 24*a*).

By assembling the "second passage member 5", the "injector body 2", and the "first passage member 4" being thus selected, it becomes possible to adjust the "rate of pressure decrease in the control chamber" to desired characteristics.

(c) In the case that the "needle valve-open requisite pressure" needs to be adjusted to desired characteristics, one of the following assembling method is employed.

(c-1) This assembling method includes a step of determining a "needle valve 8" to be assembled. Then, with the aid of the constituent part designating means such as a selection matrix, this assembling method performs a step of selecting an "adjusting plate 22*a* of a needle valve spring 22" having an ID classification (i.e., ID code classified in accordance with the set load of the valve spring 29) corresponding to an ID classification assigned to the "needle valve 8" (i.e., ID code classified in accordance with the front end seat radius of needle valve 8).

By assembling the "needle valve 8" and the "adjusting plate 22*a* of a needle valve spring 22" being thus selected, it becomes possible to adjust the "needle valve-open requisite pressure" to desired characteristics.

(d) In the case that the "needle valve rising speed" needs to be adjusted to desired characteristics, one of the following three assembling methods is employed.

(d-1) The first method includes a step of determining a "needle valve 8" to be assembled. Then, with the aid of the constituent part designating means such as a selection matrix, this assembling method performs a step of selecting a "first passage member 4" having an ID classification (i.e., ID code classified in accordance with the restricting characteristics of the inlet orifice 23*a*) corresponding to an ID classification assigned to the "needle valve 8" (i.e., ID code classified in accordance with the front end seat radius of needle valve 8), and further performs a step of selecting a "second passage member 5" having an ID classification (i.e., ID code classified in accordance with the restricting characteristics of the outlet orifice 24*a*) corresponding to an ID classification assigned to the "needle valve 8" (i.e., ID code classified in accordance with the front end seat radius of needle valve 8).

By assembling the "needle valve 8", the "first passage member 4", and the "second passage member 5" being thus selected, it becomes possible to adjust the "needle valve rising speed" to desired characteristics.

(d-2) The second method includes a step of determining a "first passage member 4" to be assembled. Then, with the aid of the constituent part designating means such as a selection matrix, this assembling method performs a step of selecting a "needle valve 8" having an ID classification (i.e., ID code classified in accordance with the front end seat radius of needle valve 8) corresponding to an ID classification assigned to the "first passage member 4" (i.e., ID code classified in accordance with the restricting characteristics of the inlet orifice 23*a*), and further performs a step of selecting a "second passage member 5" having an ID classification (i.e., ID code classified in accordance with the restricting characteristics of the outlet orifice 24*a*) corresponding to an ID classification assigned to the "first passage member" (i.e., ID code classified in accordance with the restricting characteristics of the inlet orifice 23*a*).

By assembling the "first passage member 4", the "needle valve 8", and the "second passage member 5" being thus selected, it becomes possible to adjust the "needle valve rising speed" to desired characteristics.

(d-3) The third method includes a step of determining a "second passage member 5" to be assembled. Then, with the aid of the constituent part designating means such as a selection matrix, this assembling method performs a step of selecting a "needle valve 8" having an ID classification (i.e., ID code classified in accordance with the front end seat radius of needle valve 8) corresponding to an ID classification assigned to the "second passage member 5" (i.e., ID code classified in accordance with the restricting characteristics of the outlet orifice 24*a*), and further performs a step of selecting a "first passage member 4" having an ID classification (i.e., ID code classified in accordance with the restricting characteristics of the inlet orifice 23*a*) corresponding to an ID classification assigned to the "second passage member 5" (i.e., ID code classified in accordance with the restricting characteristics of the outlet orifice 24*a*).

By assembling the "second passage member 5", the "needle valve 8", and the "first passage member 4" being thus selected, it becomes possible to adjust the "needle valve rising speed" to desired characteristics.

Next, the "needle valve rising stage injection rate" of item (e) will be explained.

The "needle valve rising stage injection rate" is determined in relation to the above-described "needle valve rising speed" of item (d) and the "injection flow amount of the nozzle" in the rising action of the needle valve 8.

More specifically, even when the "needle valve rising speed" of item (d) is unchanged, a change of the "injection flow amount of the nozzle" causes a change in the "needle valve rising stage injection rate" of item (e). On the contrary, even when the "injection flow amount of the nozzle" is unchanged, a change of "needle valve rising speed" of item (d) causes a change in the "needle valve rising stage injection rate" of item (e).

Figure 3:
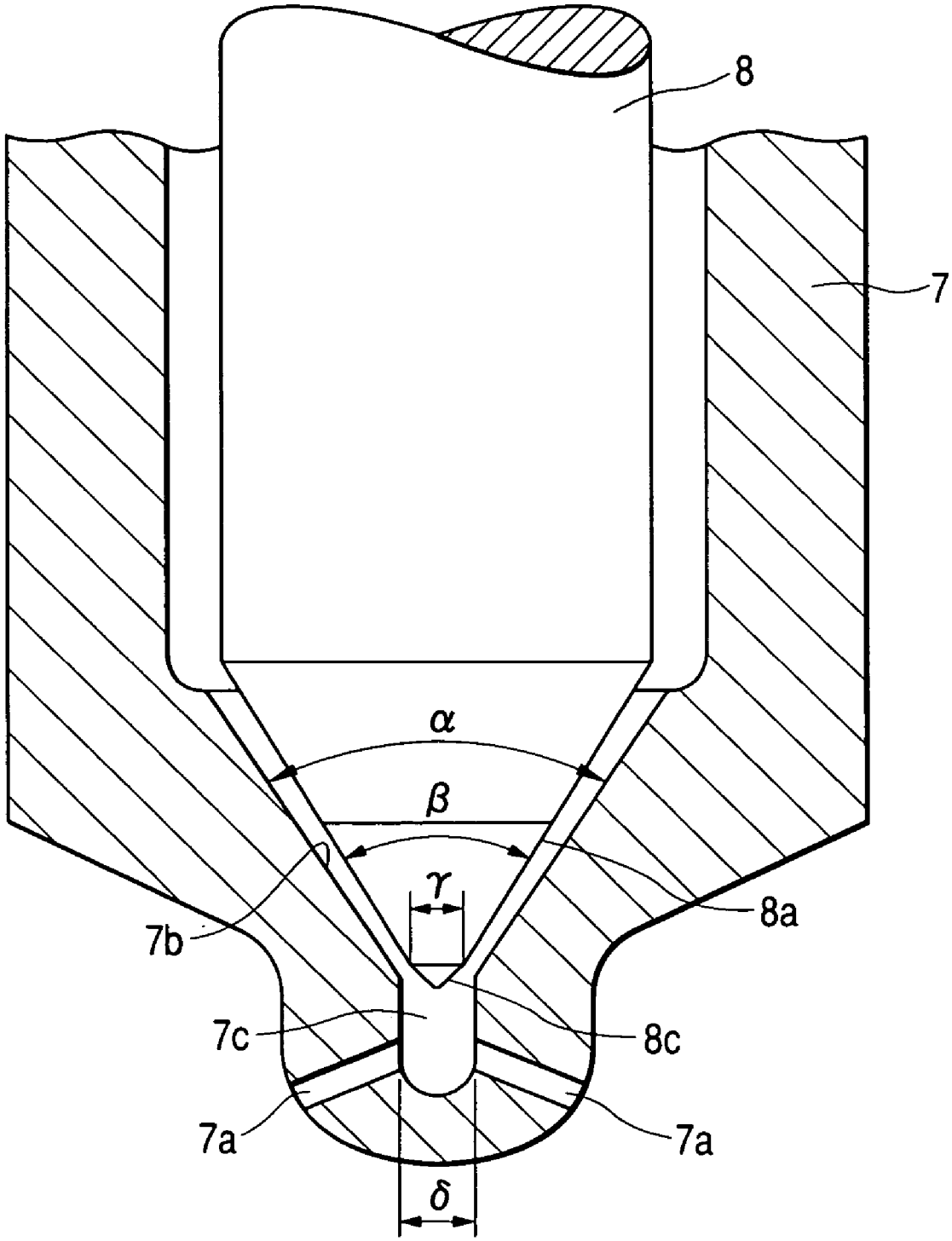
FIG. 3 is an enlarged cross-sectional view showing essential part of a nozzle of the injector in accordance with the preferred embodiment of the present invention.
Figure 4A:
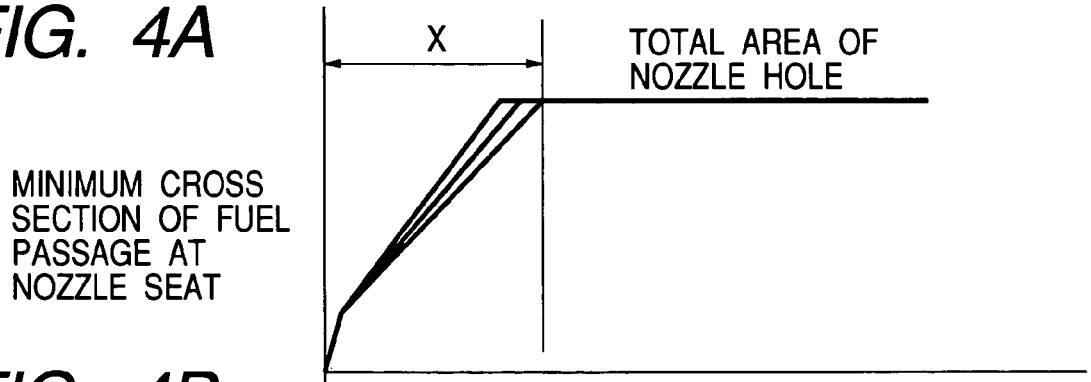
FIG. 4A is a graph showing the relationship between the minimum passage area and the needle valve lift amount.
Figure 4B:
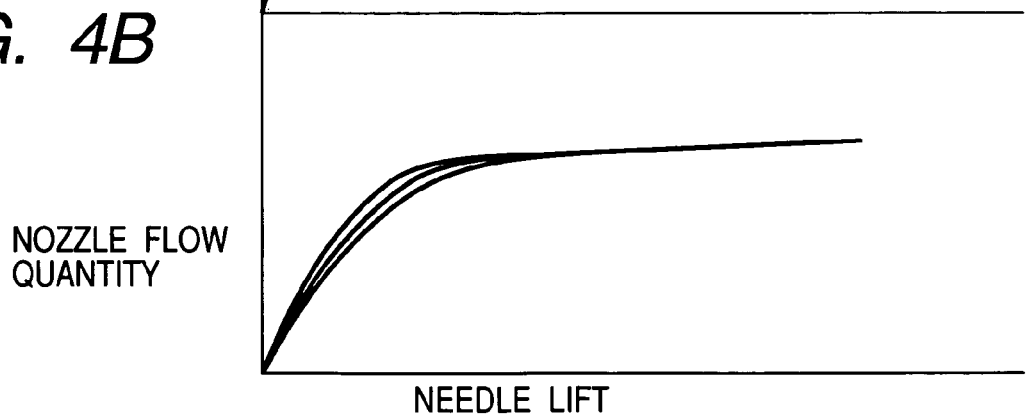
FIG. 4B is a graph showing the relationship between the nozzle flow amount and the needle valve lift amount.

Hereinafter, the "injection flow amount of the nozzle" in the rising action of the needle valve 8 will be explained with reference to FIGS. 3, 4A and 4B. FIG. 3 is an enlarged cross-sectional view showing an essential part of a nozzle. FIG. 4A is a graph showing the minimum passage area formed between the nozzle seat 7*b* and the needle seat 8*a* in relation to the lift amount of the needle valve 8. FIG. 4B is a graph showing the nozzle flow amount (i.e., the flow amount of fuel injected from the nozzle) in relation to the lift amount of the needle valve 8 under a predetermined fuel supply pressure.

As shown in FIG. 4A, before reaching the nozzle hole total area of the nozzle hole 7*a*, the clearance formed between the nozzle seat 7*b* and the needle seat 8*a* becomes the minimum passage area in the region X. The minimum passage area in this area X is different in each nozzle because of individual differences of respective nozzles, varying depending on the seat angle $\alpha$ of the nozzle seat 7*b*, the seat angle $\beta$ of the needle seat 8*a*, the diameter $\gamma$ of an escape portion 8*c* formed at the front end of the needle valve 8 (although the provision of the escape portion 8*c* is optional), and a diameter $\delta$ of a suck portion 7*c* formed at the front bottom portion of the nozzle body 7. Accordingly, as shown in FIG. 4B, the relationship between the nozzle flow amount and the needle valve lift amount is different in respective nozzles.

As a result, even when the "needle valve rising speed" of item (d) is constant, the "needle valve rising stage injection rate" of item (e) varies depending on the difference in the nozzle flow amount.

Hence, this embodiment classifies (stratifies) the nozzles in accordance with the nozzle flow amount, and also classifies (stratifies) the constituent parts influencing the "needle valve rising speed" of item (d). Then, under the instruction given from the constituent part designating means (table etc.), the nozzle and the related constituent part are appropriately assembled so as to adjust the "needle valve rising stage injection rate" of item (e) to desired characteristics.

This embodiment assigns ID code (i.e., ID classification) to each "nozzle" with reference to the nozzle flow amount. In other words, the ID codes given to respective nozzles are classified in accordance with the nozzle flow amount. It is possible to perform the classification of the "nozzle" by measuring the nozzle flow amount characteristics relative to the needle valve lift amount for each nozzle (as shown in FIG. 4B) and then assigning the ID code to each nozzle based on the measurement result. Alternatively, it is possible to select one or a plurality of points with respect to the needle valve lift amount, measure the nozzle flow amount at each selected point, and assign the ID code to each nozzle based on the measurement result.

(e) In the case that the "needle valve rising stage injection rate" needs to be adjusted to desired characteristics, one of the following two assembling methods is employed.

(e-1) The first method includes a step of determining a "nozzle" to be assembled. Then, with the aid of the constituent part designating means such as a selection matrix, this assembling method performs a step of selecting an "injector component having an ID classification (i.e., ID code classified in accordance with the rising speed of the needle valve 8) corresponding to an ID classification assigned to the "nozzle" (i.e., ID code classified in accordance with the nozzle flow amount).

By assembling the "nozzle" and the "injector component" being thus selected, it becomes possible to adjust the "needle valve rising stage injection rate" to desired characteristics.

(e-2) The second method includes a step of determining an "injector component" to be assembled. Then, with the aid of the constituent part designating means such as a selection matrix, this assembling method performs a step of selecting a "nozzle" having an ID classification (i.e., ID code classified in accordance with the nozzle flow amount) corresponding to an ID classification assigned to the "injector component" (i.e., ID code classified in accordance with the rising speed of the needle valve 8).

By assembling the "injector component" and the "nozzle" being thus selected, it becomes possible to adjust the "needle valve rising stage injection rate" to desired characteristics.

By the way, in the above-described first and second methods of items (e-1) and (e-2), one example of the "injector component" having the ID code classified in accordance with the rising speed of the needle valve 8 is the "first passage member 4" or the "second passage member 5" or other parts influencing the "needle valve rising speed" of item (d), such as the injector 1 in a condition that the nozzle is not assembled.

(f) In the case that the "maximum injection rate" needs to be adjusted to desired characteristics, one of the following two assembling methods is employed.

(f-1) The first method includes a step of determining a "nozzle body 7" to be assembled. Then, with the aid of the constituent part designating means such as a selection matrix, this assembling method performs a step of selecting a "filter 18" having an ID classification (i.e., ID code classified in accordance with the passage resistance of fuel) corresponding to an ID classification assigned to the "nozzle body 7" (i.e., ID code classified in accordance with the injection characteristics of the nozzle hole 7*a*).

By assembling the "nozzle body 7" and the "filter 18" being thus selected, it becomes possible to adjust the "maximum injection rate" to desired characteristics.

(f-2) The second method includes a step of determining a "filter 18" to be assembled. Then, with the aid of the constituent part designating means such as a selection matrix, this assembling method performs a step of selecting a "nozzle body 7" having an ID classification (i.e., ID code classified in accordance with the injection characteristics of the nozzle hole 7*a*) corresponding to an ID classification assigned to the "filter 18" (i.e., ID code classified in accordance with the passage resistance of fuel).

By assembling the "filter 18" and the "nozzle body 7" being thus selected, it becomes possible to adjust the "maximum injection rate" to desired characteristics.

(g) In the case that the "response delay in a valve falling action" needs to be adjusted to desired characteristics, the following assembling method is employed.

(g-1) This assembling method includes a step of determining a "solenoid 27" to be assembled. Then, with the aid of the constituent part designating means such as a selection matrix, this assembling method performs a step of selecting an "adjusting plate 29*a* of the valve spring 29" having an ID classification (i.e., ID code classified in accordance with the set load of the valve spring 29) corresponding to an ID classification assigned to the "solenoid 27" (i.e., ID code classified in accordance with the magnetic characteristics of the solenoid 27), and further performs a step of selecting a "valve 25 equipped with an armature 28" having an ID classification (i.e., ID code classified in accordance with the air-gap amount at the maximum lift of the valve 25) corresponding to an ID classification assigned to "the solenoid 27" (i.e., ID code classified in accordance with the magnetic characteristics of the solenoid 27).

By assembling the "solenoid 27", the "adjusting plate 29*a* of the valve spring 29", and the "valve 25 equipped with an armature 28" being thus selected, it becomes possible to adjust the "response delay in a valve falling action" to desired characteristics.

(k) In the case that the "needle valve falling speed" needs to be adjusted to desired characteristics, one of the following two assembling methods is employed.

(k-1) The first method includes a step of determining an "injector body 2" to be assembled. Then, with the aid of the constituent part designating means such as a selection matrix, this assembling method performs a step of selecting a "first passage member 4" having an ID classification (i.e., ID code classified in accordance with the restricting characteristics of the inlet orifice 23*a*) corresponding to an ID classification assigned to the "injector body 2" (i.e., ID code classified in accordance with the volume of the control chamber 15).

By assembling the "injector body 2" and the "first passage member 4" being thus selected, it becomes possible to adjust the "needle valve falling speed" to desired characteristics.

(k-2) The second method includes a step of determining a "first passage member 4" to be assembled. Then, with the aid of the constituent part designating means such as a selection matrix, this assembling method performs a step of selecting an "injector body 2" having an ID classification (i.e., ID code classified in accordance with the volume of the control chamber 15) corresponding to an ID classification assigned to the "first passage member 4" (i.e., ID code classified in accordance with the restricting characteristics of the inlet orifice 23*a*).

By assembling the "first passage member 4" and the "injector body 2" being thus selected, it becomes possible to adjust the "needle valve falling speed" to desired characteristics.

Although the above-described explanation was given in accordance with the top-to-bottom direction of the table shown in FIG. 5, the assembling order should be determined considering the priority of the output characteristics required for the injector 1.

When the table shown in FIG. 5 is referred to, a constituent part to be assembled is first designated from the upper column, and then the influential factors listed below as blank spaces are selected. In this selection, the influential factors indicated by mark are excluded as they have inseparable relationship with the designated component. And further, the influential factors indicated by the slash are also excluded from the selection as no effect is expected in adjusting the output characteristics.

EFFECTS OF THE EMODIMENT

As apparent from the foregoing description, in the processes of assembling constituent parts influencing the output characteristics of the injector, if a selected constituent part has a certain ID classification being assigned beforehand, the preferred embodiment of the present invention executes constituent part selection in accordance with an instruction of constituent part designating means which designates other constituent part having an ID classification corresponding to the ID classification assigned to the selected constituent part. Accordingly, employing this assembling method makes it possible to assure desired output characteristics for each injector 1.

More specifically, even when the injector 1 has output characteristics being not easily corrected by the electronic control unit, the preferred embodiment of the present invention makes it possible to adjust the output characteristics of the injector 1 to desired values.

Accordingly, it is unnecessary to execute the conventional correction performed by the electronic control unit which includes the step of picking up some correction points on the three-dimensional map defined by fuel pressure, injection pulse, and injection amount. Thus, a desired injection amount is obtained in a wide operating range of an engine. Furthermore, it becomes possible to set the injection rate of each injector 1 to desired output characteristics and accordingly the individual differences among the manufactured injectors 1 can be reduced greatly. It becomes possible to obtain a desired injection amount, desired injection start timing, and desired injection stop timing in a wide operating range of an engine. It becomes possible to attain the required exhaust gas purification function.

MODIFIED EMBODIMENT

The above-described injector 1 is a mere example of this invention. The present invention can be applied to other injectors having different arrangements.

For example, in the case that the present invention is applied to the 2-way valve type injector 1 as shown in the above-descried embodiment, the first and second passage members 4 and 5 respectively having the inlet orifice 23*a* and the outlet orifice 24*a* can be integrated into a single orifice plate. In this manner, the practical structure or arrangement of the injector 1 can be modified in various ways.

Furthermore, although the above-described embodiment is based on the 2-way valve type injector 1, the present invention can be applied to various kinds of injectors including an injector 1 having a needle valve 8 being directly driven by a linear solenoid (e.g., a piezo-actuator)

Furthermore, application of the present invention is not limited to the assembling of the injectors. The present invention provides a general assembling method applicable to any type of actuating apparatus which includes a plurality of constituent parts and produces an output in response to an input signal. Especially, the present invention can be preferably applied to an actuating apparatus which requires numerous mechanical parts and thus inherently possesses the output characteristics being not easily adjustable by electric adjustment only. The present invention makes it possible to adjust the output characteristics being not conventionally adjustable to desired output characteristics.

The work selecting the constituent component with the ID classification being assigned beforehand can be done by a worker in the assembling line in accordance with the instruction given from the constituent part designating means such as a selection matrix. It is also possible to provide an automated assembling apparatus that can read the information (e.g., ID classified readable data, barcode, two-dimensional code, etc) given to each component and select an appropriate constituent part according to the readout information. In this case, the automated assembling apparatus can assemble the selected part in an automated fashion.

What is claimed is:

1. A constituent parts assembling method for an actuating apparatus which includes a plurality of constituent parts and produces an output in response to an input signal, comprising the steps of:

assigning ID classification to each of said plurality of constituent parts with reference to characteristics difference of respective parts when said plurality of constituent parts give influence to output characteristics of said actuating apparatus;

in processes of assembling said constituent parts influencing the output characteristics, when a selected constituent part has a certain ID classification being assigned beforehand, executing constituent part selection in accordance with an instruction of constituent part designating means which designates other constituent part having an ID classification corresponding to the ID classification assigned to said selected constituent part; and assembling the selected plurality of constituent parts into said actuating apparatus.

2. The constituent parts assembling method for an actuating apparatus in accordance with claim 1, wherein said actuating apparatus is a 2-way valve type injector which controls a pressure in a control chamber by opening or closing an electromagnetic valve in accordance with a valve open/close signal supplied from an outside and executes a lift control of a needle valve in response to pressure change occurring in the control chamber to control the fuel injection of a nozzle.

3. The constituent parts assembling method for an actuating apparatus in accordance with claim 2, wherein in a process of assembling a constituent part influencing "response delay in a valve rising action responsive to a valve-open signal given to said electromagnetic valve to instruct an injection start" among output characteristics of said injector, said method comprises the steps of:

selecting an "adjusting plate of a valve spring which presses the valve to a valve-closing direction" having an ID classification corresponding to an ID classification assigned to a "solenoid" generating a magnetic force in said electromagnetic valve; and selecting a "valve equipped with an armature magnetically driven by said solenoid" having an ID classification corresponding to an ID classification assigned to "said solenoid."

4. The constituent parts assembling method for an actuating apparatus in accordance with claim 2, wherein in a process of assembling a constituent part influencing a "rate of pressure decrease in the control chamber from opening the electromagnetic valve to opening the needle valve" among output characteristics of said injector, said method comprises the steps of:

selecting a "first passage member having an inlet orifice for restricting pressurized fuel supplied to said control chamber" having an ID classification corresponding to an ID classification assigned to an "injector body" determining a volume of said control chamber; and selecting a "second passage member having an outlet orifice for restricting the fuel discharged from said control chamber in response to valve open of said valve" having an ID classification corresponding to an ID classification assigned to "said injector body."

5. The constituent parts assembling method for an actuating apparatus in accordance with claim 2, wherein in a process of assembling a constituent part influencing a "rate of pressure decrease in the control chamber from opening the electromagnetic valve to opening the needle valve" among output characteristics of said injector, said method comprises the steps of:

selecting an "injector body determining a volume of said control chamber" having an ID classification corresponding to an ID classification assigned to a "first passage member" having an inlet orifice restricting pressurized fuel supplied to said control chamber; and selecting a "second passage member having an outlet orifice restricting the fuel discharged from said control chamber in response to valve open of said valve" having an ID classification corresponding to an ID classification assigned to "said first passage member."

6. The constituent parts assembling method for an actuating apparatus in accordance with claim 2, wherein in a process of assembling a constituent part influencing a "rate of pressure decrease in the control chamber from opening the electromagnetic valve to opening the needle valve" among output characteristics of said injector, said method comprises the steps of:

selecting an "injector body determining a volume of said control chamber" having an ID classification corresponding to an ID classification assigned to a "second passage member" having an outlet orifice restricting the fuel discharged from said control chamber in response to valve open of said valve; and selecting a "first passage member having an inlet orifice restricting pressurized fuel supplied to said control chamber" having an ID classification corresponding to an ID classification assigned to "said second passage member."

7. The constituent parts assembling method for an actuating apparatus in accordance with claim 2, wherein in a process of assembling a constituent part influencing the "control chamber pressure that said needle valve enables to open" among output characteristics of said injector, said method comprises the step of:

selecting an "adjusting plate of a needle valve spring for pressing said needle valve to a valve-closing direction" having an ID classification corresponding to an ID classification assigned to "said needle valve."

8. The constituent parts assembling method for an actuating apparatus in accordance with claim 2, wherein in a process of assembling a constituent part influencing a "rising speed of said needle valve" among output characteristics of said injector, said method comprises the steps of:

selecting a "first passage member having an inlet orifice for restricting pressurized fuel supplied to said control chamber" having an ID classification corresponding to an ID classification assigned to "said needle valve"; and selecting a "second passage member having an outlet orifice restricting the fuel discharged from said control chamber in response to valve open of said valve" having an ID classification corresponding to an ID classification assigned to "said needle valve."

9. The constituent parts assembling method for an actuating apparatus in accordance with claim 2, wherein in a process of assembling a constituent part influencing a "rising speed of said needle valve" among output characteristics of said injector, said method comprises the steps of:

selecting a "needle valve" having an ID classification corresponding to an ID classification assigned to a "first passage member" having an inlet orifice restricting pressurized fuel supplied to said control chamber; and selecting a "second passage member having an outlet orifice for discharging the fuel discharged from said control chamber in response to valve open of said valve" having an ID classification corresponding to an ID classification assigned to "said first passage member."

10. The constituent parts assembling method for an actuating apparatus in accordance with claim 2, wherein in a process of assembling a constituent part influencing a "rising speed of said needle valve" among output characteristics of said injector, said method comprises the steps of:

selecting a "needle valve" having an ID classification corresponding to an ID classification assigned to a "second passage member" having an outlet orifice for restricting the fuel discharged from said control chamber; and selecting a "first passage member having an inlet orifice for restricting pressurized fuel supplied to said control chamber" having an ID classification corresponding to an ID classification assigned to "said second passage member."

11. The constituent parts assembling method for an actuating apparatus in accordance with claim 2, wherein in a process of assembling a constituent part influencing an "injection rate during a rising action of said needle valve" among output characteristics of said injector, said method comprises the step of:

selecting an "injector component influencing a rising speed of said needle valve" having an ID classification corresponding to an ID classification assigned to "said nozzle."

12. The constituent parts assembling method for an actuating apparatus in accordance with claim 2, wherein in a process of assembling a constituent part influencing an "injection rate during a rising action of said needle valve" among output characteristics of said injector, said method comprises the step of:

selecting a "nozzle" having an ID classification corresponding to an ID classification assigned to an "injector component influencing a rising speed of said needle valve."

13. The constituent parts assembling method for an actuating apparatus in accordance with claim 2, wherein in a process of assembling a constituent part influencing a "maximum injection rate" among output characteristics of said injector, said method comprises the step of:

selecting a "filter for filtering pressurized fuel flowing into said injector" having an ID classification corresponding to an ID classification assigned to a "nozzle body" having a nozzle hole being open/close controlled by said needle valve.

14. The constituent parts assembling method for an actuating apparatus in accordance with claim 2, wherein in a process of assembling a constituent part influencing a "maximum injection rate" among output characteristics of said injector, said method comprises the step of:

selecting a "nozzle body having a nozzle hole being open/close controlled by said needle valve" having an ID classification corresponding to an ID classification assigned to a "filter for filtering pressurized fuel flowing into said injector."

15. The constituent parts assembling method for an actuating apparatus in accordance with claim 2, wherein in a process of assembling a constituent part influencing "response delay in a valve falling action responsive to a valve-close signal given to said electromagnetic valve to instruct an injection stop" among output characteristics of said injector, said method comprises the steps of:

selecting an "adjusting plate of a valve spring which presses the valve to a valve-closing direction" having an ID classification corresponding to an ID classification assigned to a "solenoid" generating a magnetic force in said electromagnetic valve; and selecting a "valve equipped with an armature magnetically driven by said solenoid" having an ID classification corresponding to an ID classification assigned to "said solenoid."

16. The constituent parts assembling method for an actuating apparatus in accordance with claim 2, wherein in a process of assembling a constituent part influencing a "falling speed of said needle valve" among output characteristics of said injector, said method comprises the step of:

selecting a "first passage member having an inlet orifice for restricting pressurized fuel supplied to said control chamber" having an ID classification corresponding to an ID classification assigned to an "injector body" determining a volume of said control chamber.

17. The constituent parts assembling method for an actuating apparatus in accordance with claim 2, wherein in a process of assembling a constituent part influencing a "falling speed of said needle valve" among output characteristics of said injector, said method comprises the step of:

selecting an "injector body determining a volume of said control chamber" having an ID classification corresponding to an ID classification assigned to a "first passage member" having an inlet orifice for restricting pressurized fuel supplied to said control chamber.

* * * * *